United States Patent [19]

Hamaker et al.

[11] 4,040,827

[45] Aug. 9, 1977

[54] DEVELOPMENT IMAGING METHODS

[75] Inventors: Ralph A. Hamaker, Penfield; George Phillip Carr, Rochester, both of N.Y.

[73] Assignee: Xerox Corporation, Stamford, Conn.

[21] Appl. No.: 626,689

[22] Filed: Oct. 29, 1975

[51] Int. Cl.[2] ..... G03G 15/10; G03G 13/10; B05D 1/28

[52] U.S. Cl. ..... 96/1 LY; 427/16

[58] Field of Search ..... 427/15, 16, 17; 96/1 LY, 1 TE

[56] References Cited

U.S. PATENT DOCUMENTS

| | | | |
|---|---|---|---|
| 3,084,043 | 4/1963 | Gundlach | 96/1 LY |
| 3,806,354 | 4/1974 | Amidon et al. | 427/16 X |
| 3,834,930 | 9/1974 | Amidon et al. | 427/17 |

*Primary Examiner*—James R. Hoffman

*Attorney, Agent, or Firm*—James J. Ralabate; Eugene O. Palazzo; James H. Laughlin

[57] ABSTRACT

An imaging method is given whereby a latent electrostatographic image is developed by a developer containing liquid developer dispensing roll having excellent dimensional stability and resiliency having a thin, hard surface carrying the liquid developer on a resilient shell supported by a hard metal shaft.

7 Claims, No Drawings

DEVELOPMENT IMAGING METHODS

This invention relates to the development of electrostatic latent images. More particularly, this invention relates to the development of electrostatic latent images by the use of liquid toners or developers. Specifically, this invention relates to methods and manufacture for dispensing liquid toner or developer to a receiving surface.

In the process of electrostatographic imaging as disclosed, for example, in U.S. Pat. No. 2,297,691, a plate comprising a layer of photoconductive insulating material on a conductive backing, is given a uniform electric charge over its surface and is then exposed to the subject matter or copy to be reproduced, usually by conventional projection techniques. This exposure discharges the plate in areas according to the radiation intensity thereby creating an electrostatic latent image on or in the photoconductive layer. Development of the latent image is accomplished with an electrostatically charged, finely-divided, developing material or toner which is brought into surface contact with the photoconductive layer and is held thereon electrostatically in a pattern corresponding to the electrostatic latent image. Thereafter, the developed powder image is usually transferred to a support surface, such as paper, to which it may be fixed by any suitable means.

Development of an electrostatic latent image may also be achieved with liquid rather than dry developer materials. In this technique,, electrostatic latent images are developed generally using the liquid development formulations, processes and apparatus generally disclosed in U.S. Pat. Nos. 3,084,043 and 3,806,354 which are herein incorporated by reference. In these methods, an electrostatic latent image formed as mentioned above is developed or made visible by presenting to the imaging surface a liquid toner or developer on the surface of an applicator roll or developer dispensing member having a plurality of raised portions or "lands" defining a substantially regular patterned surface and a plurality of portions depressed below the raised portions or "valleys". The depressed portions of the applicator roll member contain a layer of liquid toner which is maintained out of contact with the electrostatographic imaging surface. Development is achieved by moving the developer dispensing member loaded with liquid developer in the depressed portions into developing configuration with the imaging surface. The liquid developer is attracted from the depressed portions of the applicator surface to develop the image bearing surface. The developer liquid may be pigmented or dyed. The development system disclosed in U.S. Pat. No. 3,084,043 which is sometimes called "out of contact" development differs from electrophoretic development systems where substantial contact between the liquid developer and both the charged and uncharged areas of an electrostatic latent imaging surface occurs during development.

The applicator rolls employed in out of contact liquid development processes are carefully produced and are of substantially uniform characteristics. The working surface of such rolls for application of a liquid developer to an electrically charged photoreceptive surface is composed, for example, of a multihelicold thread pattern having up to about 300 threads per inch at about 45° right or left hand lead. Other angles from about 20° to about 80° from axis may be used. The thread configuration is typically about 0.0005 inch pitch, about 0.001 inch top land, and with about 35 to 65 micron depth. The overall roll size may be typically about 1.5 inch in diameter and approximately 9 inches in length, exclusive of journals.

The applicator rolls generally run either in touching contact or in very close proximity to the latent image bearing surface. This surface may be of any dielectric material or it may be a photoreceptor. The photoreceptor may comprise a suitable sensitive material coated on any suitable base. Any suitable photoconductive material and substrate may be employed. Preferred photoconductors are selenium, selenium alloys, and halogen-doped selenium, but organic photoconductors may be used. Typical substrates are nickel, brass and aluminum. If desired, there may be an interfacial layer between the photoconductive material and the substrate to provide selected adhesive or electrical properties and there may be an insulating coating over the photoreceptor. As an additional alternative, a web may be interposed over the photoreceptor between the photoreceptor and the applicator. In such an arrangement, liquid toner or developer is developed onto the web and later is transferred from the web to a receiving substrate.

It should be quite evident that the two structures, the photoreceptor and the applicator roll, must operate in close conformance and tolerances with one another in order to form a high quality image.

In compact electrostatic copying devices, the photoreceptor and applicator roll are typically small diameter cylinders to facilitate operation in confined space. However, belt-like surfaces are also employed. Such operation typically occurs at speeds of about four to ten inches per second, although moving contact resulting in the transfer of liquid developer from an applicator to a photoreceptor can occur at speeds ranging generally from about 2 to about 70 inches per second. Liquid development of images at such speeds makes cooperation of the photoreceptor and applicator roll necessary.

Once the developer is properly applied to the applicator roll and its patterned or gravure-like surface, the developer must be cleaned from the lands or raised portions prior to to contact with the latent image bearing surface. This requires close conformance and tolerances between the applicator surface and a doctoring mechanism such as a blade or web. Effective doctoring or cleaning of excess developer from the applicator roll land surfaces will also result in removal of at least some of the developer from the applicator roll valleys due to surface tension characteristics of the developer.

The quality of the applicator roll is a critical issue in the out of contact liquid development process. Materials which are useful in manufacturing the applicator roll are limited. The surface conformance between a hard metal applicator roll and a hard photoreceptor surface is very critical since very poor development occurs if there is any non-uniform separation, yet photoreceptor damage results if a hard applicator roll is too close, not in perfect alignment, and not straight with the photoreceptor.

Producing a high quality finished metal roll under commercial conditions having little tolerance deviation is technically difficult. Mechanical engraving requires a number of steps. A master layout of the pattern, opposite hand, many times size, is made on a polyethylene terephthalate resin material; the master layout is photographically reduced to the proper size, again on a clear polyethylene terephthalate resin material; and then the master pattern is transferred to a hardened and ground tool steel master engraving cylinder by a photoetching process. Only the pattern outline is transferred, not the pattern depth; the photoetched master engraving cylinder is mechanically etched by a master engraving to the desired depth and contour. This step is critical and requires great skill. The tools and equipment used are relatively simple and very similar to a jeweler's etching equipment. Subsequent engraving success depends almost entirely on the skill of the master engraver; the master cylinder is then used to make master mills for the engraving of rolls; a roll blank is machined to tolerance by conventional means. An extension is left on one end and this is used to drive the roll during the mechanical engraving process. After engraving, the extension is machined off. The roll material is usually A1S1, 1015 or 1020 steel; the roll is now ready for engraving. During the-engraving process, the roll is placed in a special lathe designed for this purpose. The roll is placed in the machine with the roll journals supported by bronze U-shaped bearings. The extension that is left on the roll is engaged in a floating chuck that drives the roll during the engraving process. The master engraving mill is mounted in a tool holder directly above the roll. The tool holder rests on the lathe bed and is driven back and forth by a lead screw. The master mill freely floats in the U-shaped bronze bushings in the tool holder. By means of an adjusting wheel, it is brought in contact with the rotating blank roll, picks up the speed of the blank roll and is driven by frictional contact. The advance along the blank roll is controlled by the lead screw driving the tool holder. The blank roll rotates very slowly, usually no more than 15 rpm. The advance of the master mill along the length of the blank roll is also very slow, approximately 1 inch over 3 minutes for small rolls and considerably slower for larger rolls. On larger rolls it is nearly impossible to see the mill advance down the roll as it is moving so slowly. The master mill is rarely bottomed in a single pass. Usually at least two passes are required on every roll and sometimes considerably more. The amount of infeed per pass is at the discretion of the operator. During engraving, the roll is continuously flooded with lubricant. After engraving, the journal extension is machined off, and the roll is degreased and given a flash coating of copper; the final step consists of plating with a thin coat of hard chromium. Both plating operations require considerable skill and the usual plating setup normally would not plate completely and uniformly into such intricate configurations.

Other roll manufacturing processes which are simpler in nature have one or more deficiencies. For example, multi-die thread cutting has some feasibility for producing a multihelicoid pattern, however, it is very difficult to obtain about a 45° lead angle with this process, the maximum lead angle obtainable usually being about 25° from the normal to the axis. In producing a multihelicoid pattern on an applicator roll, usually a minimum of 150 threads per inch are desirable and about 180 threads per inch are preferred. With multi-die thread cutting, it is difficult to produce a die of about 180 threads per inch. Further, a special chucking machine that can feed small rolls at about 0.5 inch per revolution is required for a small roll such as one about one inch in diameter and about 9 inches in length. However, even this rate of feed is quite slow and compounded with the considerable amount of set up time required, this process provides low rates of productivity. Photo engraving/chemical etching also has some feasibility for producing patterned rolls except for one major drawback. That is, it is very difficult to line up and join the ends of the overlay to produce a continuous pattern. A further limitation is that the maximum etched depth obtainable is usually about 25 microns. Cylindrical panographic engraving equipment can produce a multihelicoid pattern, but again the alignment of the thread pattern is a problem the same as occurs in the photoengraving process. An electronic automatic cylinder engraving machine may produce about a 180 TPI at about a 45° lead angle multihelidoid pattern, or other patterns, on a continuous cylindrical surface. However, since it is a true engraving process, it is slow and thus costly. Electrochemical grinding is also unsatisfactory for fabricating a roll having about 180 TPI because the finest grinding wheel has an individual particle size nearly as large as the largest thread feature.

With these and other problems associated with metal applicator rolls, attempts have been made to use polymers and other elastomeric materials. Thermal expansion, swelling, elastic recovery, and pattern distortion are all problems which have made the use of such materials difficult. Casting techniques using such materials appear to be impractical. Open casting attempts have generally failed because of poor concentricity control and unreliable mold filling. Spin casting is generally associated with shell-mounting difficulties.

Since nearly all presently known processes for manufacturing applicator rolls in sufficient quantities are deficient in one or more vital areas, there is a continuing need for an improved roll and method of fabricating the rolls.

It is an object of this invention to provide for an improved development process. It is a further object to provide for a unique applicator roll. It is yet a further object of this invention to provide for an applicator roll which has dimensional and surface stability during operation. It is a further object to provide a unique process for producing applicator rolls. Other objects and advantages will become apparent from a full reading and understanding of this specification and claims.

The above objects and others are accomplished by a hard, dimensionally stable, thin, thermosetting surface carrying the desired applicator surface pattern coated over a resilient layer which is supported by a hard metal shaft.

One method of making the desired fine-textured applicator roll comprises embossing a resilient-sleeve covered steel shaft which is coated with a thin, uncured thermosetting material. After receiving the imprint of the desired pattern, the embossed blank is separated from the master and heat cured.

Embossing is usually performed by passing a flat sheet of material termed the blank through an interface zone created by a master, the patterned roll, and a back-up roll. The embossing roll pulls the blank through the nip, impressing an exact replica of its inverse pattern into the relatively soft surface. Since the flat sheet is generally continuous, there is no need to match first and last teeth of the embossed pattern. This technique can also be used to emboss a continuous pattern on circumferential or endless surfaces, providing the pattern pitch is sufficiently fine and the material structurally weak enough to allow formation of integral numbers of "teeth" or lands.

Non-integral teeth, such as formed during the first revolution of a blank whose circumference is mismatched with the master's can be integrally formed by movement of material around the circumference during embossing. The quality of the tooth profile depends upon the pitch diameter established within the blank's surface. The process of averaging out non-integral tooth errors is quite complicated and involves continual redistribution of material and reformation of pitch diameters throughout the process. During embossing, last-tooth error averaging is a function of the physical properties of the coating material and its substrate. The floating support of the blank allows the continual formation of pitch circumference, depending upon the variation of nip pressure and coating viscosity. This tooth averaging phenomenon continues to occur until a stable pitch circumference is established. Failure to stabilize the pitch circumference will result in pattern distortions.

Any hard shaft material may be employed in this invention. Steel, stainless steels, nickel, brass or any other like material may be used. It is preferred to use conductive materials.

An elastomer or elastomeric-like, resilient material is used to cover the shaft. Materials such as nitril-butadiene rubber, resilient polyurethane rubber silicone rubber, isoprene rubber, chloroprene rubber, styrene-butadiene rubber, butadiene rubber, and the like may be employed. These materials should have a Shore A hardness of from about 50 to 90 but values of about 70 are preferred. Wall thicknesses of this resilient material should be from about 0.05 to about one inch; thicknesses of from about 0.09 to about 0.20 inch are preferred.

Particularly preferred resilient substrate materials include nitrile rubber tubing, Compound 3431 modified, and molded conductive neoprene ($10^5$ ohm-cm), 70 Shore A, both from American Roller Co., Union Grove, Wisc., and molded conductive polyurethane ($10^5$ ohm-cm) 70 Shore A, from Garlock, Inc., Rochester, N.Y.

The resilient substrate material may be in the form of tubing which is placed around the hard metal shaft or material molded around the shaft. Injection molding of the resilient, elastomeric-like material is preferred.

Preparation of the blank is an important step in the manufacture of an applicator. While minor surface errors of the blank may be averaged out during final coating, existence of these can affect the efficiency of the process. A finish grind operation for sizing and straightening may be desirable if necessary in order to have a uniform quality final product.

One important characteristic of this invention lies in the surface coat. It has been found that a thin layer of thermosetting material applied to the resilient covered shaft, gives the applicator roll of this invention dimensional stability coupled with the resiliency necessary to provide for good photoreceptor/applicator roll system conformance without the high potential of damage to the relatively fragile photoreceptor surface.

Many materials are useful in providing a surface in this invention. It has been found that polyurethanes are particularly useful in this invention. A fine applicator pattern is faithfully formed in the elastomer, and if uncured, this pattern must be retained until the coating is fully cured. The quality of the rolls are normally controlled in large measure by the viscoelastic properties of the elastomeric coating and by its curing behavior. Embossing is the preferred way to create the desired pattern.

Early in embossing, the stress level is very high because contact is restricted to the lands of the master. As the material deforms, the contact area increases until total contact is reached and the stress level is lower. After total contact there is no longer gross deformation, but internal viscous flow continues to redistribute stress in the elastically deformed material and this stress relaxation serves to reduce the magnitude of the elastic recovery.

For preferred embossing, the coating should have a low viscosity and a high elastic modulus (low elastic compliance). However, the need for tracking of the master lands in the formed grooves places a lower limit on this viscosity. Also, the cohesive (viscoelastic) strength must be greater than the adhesive attraction to the master roll to prevent "hot offsetting".

In using many materials, when the formed roll is removed from the embossing fixture, residual elastic recovery tends to decrease the depth of the grooves; this is called "slump". Surface tension will also promote leveling. Thus, the viscosity of the material must be high to counteract these forces, but unfortunately, viscosity normally decreases with increases in temperature which are usually associated with curing.

Thixotropy of the coating material resists the leveling forces, chiefly elastic recovery and surface tension, until the material is cured. Thixotropy describes a charge in viscosity with time at constant shear rate. Viscosity decreases after an increased shear rate is imposed upon a material and eventually reach an equilibrium value. If the shear rate is reduced or removed, the viscosity will increase with time until a higher equilibrium value is reached. Initial viscosity is a function of shear history. Thixotropy is believed due to a change in intermolecular forces, molecular ordering, or in filled systems, the interparticle attachments. The energy input from a shear field breaks down the order or attachments, and when the shear field is removed, thermal motion permits reordering or rebonding.

It has been found that uncured polyurethane material which has carbon black pigment dipsersed therein so that the volume resistivity is about $10^5$ ohm-cm has the proper properties to be embossed in such systems.

The excellent properties of the pigmented urethane elastomer are believed directly due to the controlled thixotropy which is controlled by the carbon black structure. Improved materials are obtained by the addition of less than about 20 percent by weight fumed silica which improves the thixotropy. Well dispersed amounts of about 2 to about 8 percent are preferred.

Any blocked urethane which has an unblocking temperature of greater than about 100° C and preferably between 120° and 175° C may be employed. Preferably such materials are diluted with solvents such as xylene and/or toluene to a viscosity of about 100 centipoise for application.

The urethane is sprayed, dipped, or applied in any other conventional way to provide a uniform coating of between 4 and 12 mils. A thickness of 5 to 7 mils is preferred.

One technique for accomplishing uniform coating is spraying. This is within the average skill of the art. It has been found useful to apply about two mils per pass using a pot pressure of 20 psi and an airline pressure of 45 psi. Three passes will generally coat the resilient covered shaft.

The coated roll should be allowed to dry thus releasing the solvents prior to embossing. A period of from a few minutes to 24 hours is required depending upon the solvents employed. After this time the viscosity is stabilized which allows for optimum embossing.

An engraved metal master prepared in accordance with techniques previously described or any other high quality technique is prepared employing the negative of the pattern to be produced. The embossing master and the blank are brought together and rotated for a period of time under pressure to impact the desired pattern in the surface of the blank.

Embossing may be accomplished at any temperature but it has been found that rolls of improved quality are achieved where the operation is conducted at room temperature, that is temperatures of from about 18 to about 35° C. The viscosity of the thixotopic polyurethane is sufficiently high at room temperatures that offsetting does not occur. Under these conditions a mold release agent is not necessary, but such an agent may be optionally used.

The master is brought into contact with the urethane coated resilient covered shaft and rotated while contact pressure is increased. Any effective contact force may be employed but it is preferred to use pressures of about 20 to about 30 pounds per lineal inch when embossing at room temperature. Contact is maintained for from 2 to about 20 minutes but can be extended in the case of poorly coated blanks. After a few revolutions, a rippling or "flowing" of the pattern may be observed which is a reorientation of material to eliminate last-tooth errors. This pattern flow is really the phenomenon of cross threading appearing and disappearing. Separation may be accomplished by sudden release.

Upon release, the uncured urethane surfaced, patterned applicator roll is cured. Any curing technique may be employed. The roll may be placed in a hot air oven at between about 100° C and about 225° C and cured for from one to fifteen minutes or so. Typically, baking at 120° C for from 10 to 12 minutes will unblock the urethane and initiate curing. Materials having higher thixotropic characteristics can be cured more rapidly thereby avoiding material deformation if such a tendency is found. Following the heating step, the roll should be allowed to stand at room temperature for full curing. It is preferred to allow about 18 to about 72 hours of room temperature cure to develop full properties.

Curing may be accomplished simultaneously with embossing. In this step, the coated roll is heated for from about 4 to about 10 minutes at temperatures of from about 150° to 90° C prior to embossing. The engraved master may optionally be heated. The embossing step is then carried out as described above except that a radient heat source is employed to maintain the surface temperatures. Again, upon release, the cured embossed roll should be allowed to stand for full property development.

Any other effective technique can be used for preparing the rolls of this invention. The following non-limiting examples further demonstrate the invention. All parts and percentages are by weight unless otherwise given.

EXAMPLE I

A steel shaft having a length of 12 inches and a diameter of about 0.75 inch was covered with about 0.20 inch wall thickness of a molded, conductive Neoprene rubber. The Neoprene rubber, available from American Roller Company, Union Grove, Wisconsin, was blended with carbon black in a roll mill to achieve a resistivity of $10^5$ ohm-cm and a hardness of 70 Shore A prior to being injection molded about the steel shaft and simultaneously cured. The coated shaft was ground to a constant diameter.

The surface of the ground covered shaft was spray coated with a five mil dry thickness of a solvent based, end blocked, thermosetting polyurethane elastomer containing dispersed carbon black to achieve a volume resistivity of $10^5$ ohm-cm and fumed silica to enhance its thixotopic properties. This material is available from Hughson Chemical Company, a division of Lord Corporation, Erie, Pa. under the trade designation Chemglaze TS-1960-71. This material is strongly shear thinning; at 40° C, the viscosity decreased from $10^7$ poise to $10^6$ poise when the shear stress is increased from $4.0 \times 10^4$ to $1.25 \times 10^5$ dynes per square centimeter. The thixotropic yield stresses were $5 \times 10^4$ and $9 \times 10^4$ dynes per square centimeter at 65° C and 56° C, respectively. The urethane cures at 150° C.

The uncured urethane coated, neoprene covered steel shaft was mounted on centers. A cleaned engraved steel master was employed having a uniform pattern of helical grooves, 65 $\mu$m in depth, inclined at 67 ½ ° to the roll axis, and spaced at 180 threads per inch. This patterned master was engaged with the rotating urethane coated blank and driven through frictional contact with it. The embossing process was achieved by the intimate contact between the surfaces of the urethane coated blank and the engraved steel master. The gage pressure between the two surfaces is increased to a maximum of 25 pounds per lineal inch of roll while the two rolling surfaces increase in spend to 60 revolutions per minute. Embossing is continued for about 10 minutes and at the end of the process separation is achieved by a spring mounted quick release mechanism in order to avoid destruction of the freshly embossed pattern.

The embossed roll is placed in a hot air oven having a temperature of 120° C for about ten minutes which fixes the surface of the pattern by curing. Full depth curing is accomplished by letting the roll stand at room temperature for about 48 hours.

EXAMPLE II

The process of Example I was repeated in every detail except that prior to embossing the coated roll was heated in a hot air oven for about eight minutes at a temperature of 125° C to partially precure the polyurethane. The roll was then mounted and engaged for embossing. The engraved master and the precured blank undergoing embossing were placed radient heat such that the surface temperature of the urethane was about 120° C. The embossing and curing were accomplished simultaneously and after about 10 minutes the roll was completed.

EXAMPLE III

The process of Example I was substantially repeated producing different rolls to demonstrate that the process had wide latitude in its variables. The results from a representative mnumber of these tests made after substantial development was complete is shown below.

| ROLL NO. | SLEEVE DUROMETER (SHORE A) | SLEEVE THICKNESS (inches) | COATING THICK-NESS (inches) | CURED DEPTH (microns) | LAND HGT. DEVIATION (microns) | SURFACE WAVINESS (microns) | LAND RADIUS (microns) |
|---|---|---|---|---|---|---|---|
| AM-53 | 73 | 0.095 | 0.004 | 46 | 4.8 | 40 | 24 |
| AM-54 | 73 | 0.095 | 0.004 | 44 | 2.5 | 42 | 34 |
| G-66 | 75 | 0.119 | 0.006 | 43 | 6.2 | 32 | ? |
| R-45 | 83 | 0.183 | 0.005 | 51 | ? | ? | ? |
| G-33 | ? | 0.09 | 0.004 | 55 | 3.8 | 25 | ? |
| No.3 | 75 | 0.09 | 0.004 | 53 | 3.8 | 21 | 29 |
| G-50 | 76 | 0.09 | 0.009 | 42 | 6.2 | 15 | 40 |
| G-46 | 75 | 0.09 | 0.006 | 43 | 3.8 | 15 | 36 |
| R-42 | 83 | 0.205 | 0.006 | 45 | 6.2 | 38 | 40 |

EXAMPLE IV

An imaging system similar to that shown in U.S. Pat. No. 3,656,948 is assembled. A hard photoconductor in the form of a drum comprising a surface layer of selenium about 50 microns thick on a conductive metal substrate is positively charged to about 450 volts and exposed to a light and shadow image in a conventional manner. This exposure forms the electrostatic latent image on the surface of the photoreceptor conforming to the dark areas of the light and shadow pattern.

The applicator roll formed in Example I is mounted in the developer housing in contact with the photoreceptor surface. The developer employed was of the following composition:

30 parts mineral oil which serves as a vehicle having a kinematic viscosity of about 15.7 – 18.0 centistokes at 25° C and a specific gravity of 0.85 available from Pennsylvania Refining Company under the tradename Drakeol 9;

18 parts by weight of a resinated predispersed carbon black pigment composed of about 40 percent carbon black pigment and 60 percent ester gum resin available from CIBA under the tradename Microlith CT;

3 parts by weight methyl violet tannate;

15 parts by weight of an alkylated polyvinyl pyrrolidone which serves as an additional pigment dispersant and secondary vehcile; and 0.5 part by weight of a synthetic wax available from Moore and Manger, Inc., under the tradename Paraflint RG. This developer was well mixed and placed in the developer housing. During operation the developer loaded the applicator roll and was doctored so that the land areas were clean. The applicator roll which was resilient gently contacted the selenium drum surface and developer carried in the grooves of the applicator was drawn to the electrostatic latent image in image configuration making visible the image. The speed of development was 10 inches per second.

The developed image was transferred to paper and the copy examined. It was found in general to be equal to to that produced by a mechanically engraved low carbon steel which had been chromium plated having substantially the same pattern as the applicator roll prepared in Example I.

EXAMPLE V

Example IV was repeated in substantially every detail except that a standard test pattern having both line copy and solid area copy was employed. One thousand copies were produced and visually examined for quality. Quality appeared to be uniformly maintained from the first to the last copy and that quality was substantially the same as that found in Example IV.

EXAMPLE VI

The photoreceptor of Example IV and V was visually examined to determine if any surface damage occurred during the extended copying cycle. No surface damage, scratches, or gouges appeared.

Although specific materials and conditions are set forth in the foregoing examples, these are merely intended as illustrations of the present invention. Various other suitable roll materials such as those listed above may be substituted for those in the examples with similar results. Other materials may also be added to the roll materials to sensitize, synergize or otherwise improve the fabricating properties or desirable properties of the process.

Other modifications of the present invention will occur to those skilled in the art upon a reading of the present disclosure. These are intended to be included within the scope of this invention.

What is claimed is:

1. A method of cyclically developing an electrostatic latent image on a reusable imaging surface comprising forming an electrostatic latent image on the imaging surfaces, developing the image with a liquid developer carried in the valleys of a patterned applicator roll comprising a hard, dimensionally stable, patterned surface having a thickness of from about 4 to about 12 mils and having a plurality of lands and valleys, said surface covering a deformable, resilient substrate having from about 0.05 to about one inch thickness and a Shore A hardness of from about 50 to about 90 on a support, transferring the developing image from the imaging surface to a receiving surface in image configuration, and repeating the cycle at least one additional time.

2. The method of claim 1 wherein the hard, dimensionally stable, patterned surface comprises a thermosetting polymer.

3. The method of claim 2 wherein said polymer comprises a polyurethane having a volume resistivity of about $10^5$ ohm-centimeters.

4. The method of claim 2 wherein said polymer comprises polyurethane having added thereto less than about 20 percent by weight fumed silica.

5. The method of claim 1 wherein said resilient substrate has a volume resistivity of about $10^5$ ohm-centimeters.

6. The method of claim 1 wherein said resilient substrate has a Shore A hardness of from about 50 to about 90.

7. The method of claim 1 wherein said resilient substrate comprises a resilient elastomer-like material having a Shore A hardness of about 70.

* * * * *